US005426907A

United States Patent [19]

Franklin

[11] Patent Number: 5,426,907

[45] Date of Patent: Jun. 27, 1995

[54] CONSTRUCTION CRANE BASE

[76] Inventor: James W. Franklin, 1611 Francisca Rd. NW., Albuquerque, N. Mex. 87107

[21] Appl. No.: 86,007

[22] Filed: Jul. 1, 1993

[51] Int. Cl.[6] ..... E04F 21/00; E04G 21/16

[52] U.S. Cl. ..... 52/749; 212/175; 212/253; 52/127.1

[58] Field of Search ..... 52/749, 127.1, 127.2; 212/175, 176, 179, 253

[56] References Cited

U.S. PATENT DOCUMENTS

| | | | |
|---|---|---|---|
| 673,384 | 5/1901 | Clark . | |
| 785,289 | 3/1905 | Campbell . | |
| 3,053,398 | 9/1962 | Liebherr et al. | 212/176 |
| 3,127,996 | 4/1964 | Schwing | 212/176 |
| 3,153,486 | 10/1964 | Strnad | 212/176 X |
| 3,302,749 | 2/1967 | Heaphy et al. | 182/82 |
| 3,333,712 | 8/1967 | Owen | 212/176 |
| 3,366,251 | 1/1968 | Strnad | 212/176 |
| 3,776,498 | 12/1973 | Peters et al. | 248/221 |
| 3,923,163 | 12/1975 | Brewer | 212/175 |
| 4,002,222 | 1/1977 | Bruno | 182/183 |
| 4,452,336 | 6/1984 | Sickler | 182/82 |
| 4,732,234 | 3/1988 | Brickman | 182/183 |
| 4,856,662 | 8/1989 | Marvin et al. | 212/175 X |
| 4,909,350 | 3/1990 | Jacobs | 182/82 |
| 4,953,720 | 9/1990 | Okano et al. | 212/176 |
| 5,255,489 | 10/1993 | Matsumoto et al. | 52/749 X |

FOREIGN PATENT DOCUMENTS

| | | | |
|---|---|---|---|
| 711646 | 6/1965 | Canada | 182/14 |
| 3-3893 | 1/1991 | Japan | 212/175 |
| 4-191295 | 7/1992 | Japan | 212/176 |
| 1461749 | 2/1989 | U.S.S.R. | 212/179 |

*Primary Examiner*—Carl D. Friedman
*Assistant Examiner*—Kevin D. Wilkens
*Attorney, Agent, or Firm*—Flehr, Hohbach, Test, Albritton & Herbert

[57] ABSTRACT

A platform assembly is designed for use in supporting a crane during the construction of a multi-story building. The assembly includes a platform for supporting a crane and means for cantilevering the platform from differing locations along the length of a structural column of such building during construction of the latter.

13 Claims, 4 Drawing Sheets

CONSTRUCTION CRANE BASE

BACKGROUND OF THE INVENTION

The present invention relates to multi-story building construction and, more particularly, to a crane arrangement which facilities such construction.

In the construction of multi-story (high rise) buildings it is common to have one or more temporary crane arrangements for hoisting material and other loads to various elevations for such construction. These cranes often have long horizontal booms to provide access to much of the area of the building. Such temporary cranes typically are dismantled and removed when there is no longer a construction need for the same.

SUMMARY OF THE INVENTION

The present invention eliminates the need for temporary cranes of the type heretofore used. In its basic aspects, the invention is a crane platform assembly which includes both a platform for a crane and means for fixedly attaching the platform to a column of the structural frame of the building at differing, generally vertical locations. The attaching means cantilevers the platform from the column. It is typical to construct a building with a multiplicity of vertical structural frame columns. Such columns are the first component parts of a building structural frame to be erected. In concrete building construction, these vertical columns generally are concrete filled structural frame column sections. (It should be noted that it is becoming increasingly common to construct composite columns for concrete buildings, columns which include a metal tube or the like which is filled with HIGH STRENGTH concrete.) The remainder of the structural frame for the building then becomes the concrete slabs which are provided separating each level, such slabs acting as diaphragms connecting the multiple columns and the building core together. The structural frame contribution of these slabs is quite important. In this connection, slabs of this nature are often referred to as "ductal" slabs in building constructions designed to resist earthquakes and are connected with the frame members in a manner to prevent the structural frame rigidity associated with earthquake damage. In steel structures, structural vertical columns are part of a structural frame for the building.

With the invention a structural frame column of either a concrete or steel building provides two functions it not only acts as part of the building structure as is common, but during the construction of the building acts to support a crane. The attaching means or, in other words, the cantilevering means for the crane platform most desirably includes a collar configured to circumscribe a vertical structural column at the differing heights, preferably adjacent structural bracing for the column. (In this connection, it must be remembered that the slabs themselves are structural bracing.) A hoist arrangement also is included for moving the crane platform assembly vertically between the differing locations at which it is to be attached to the column. The structural column also desirably is a corner column for the building. The use of a corner column provides certain advantages which will become apparent from the more detailed description.

The crane is able to ROTATE on the platform as may be desired to hoist or place material at particular locations. Also, most desirably a pivot is provided in the platform to enable the platform to be rotated in a generally horizontal plane relative to the vertical structural column.

The invention also includes a construction method in which a crane is secured at different locations vertically along the length of a structural column. In this connection, use of the crane platform assembly of the invention enables much faster and less expensive construction.

Other features and advantages of the invention either will become apparent or will be described in connection with the following, more detailed description of preferred embodiments of the invention.

BRIEF DESCRIPTION OF THE DRAWING

With reference to the accompanying drawing.

DETAILED DESCRIPTION OF THE PREFERRED EMBODIMENT(s)

Figure 1:
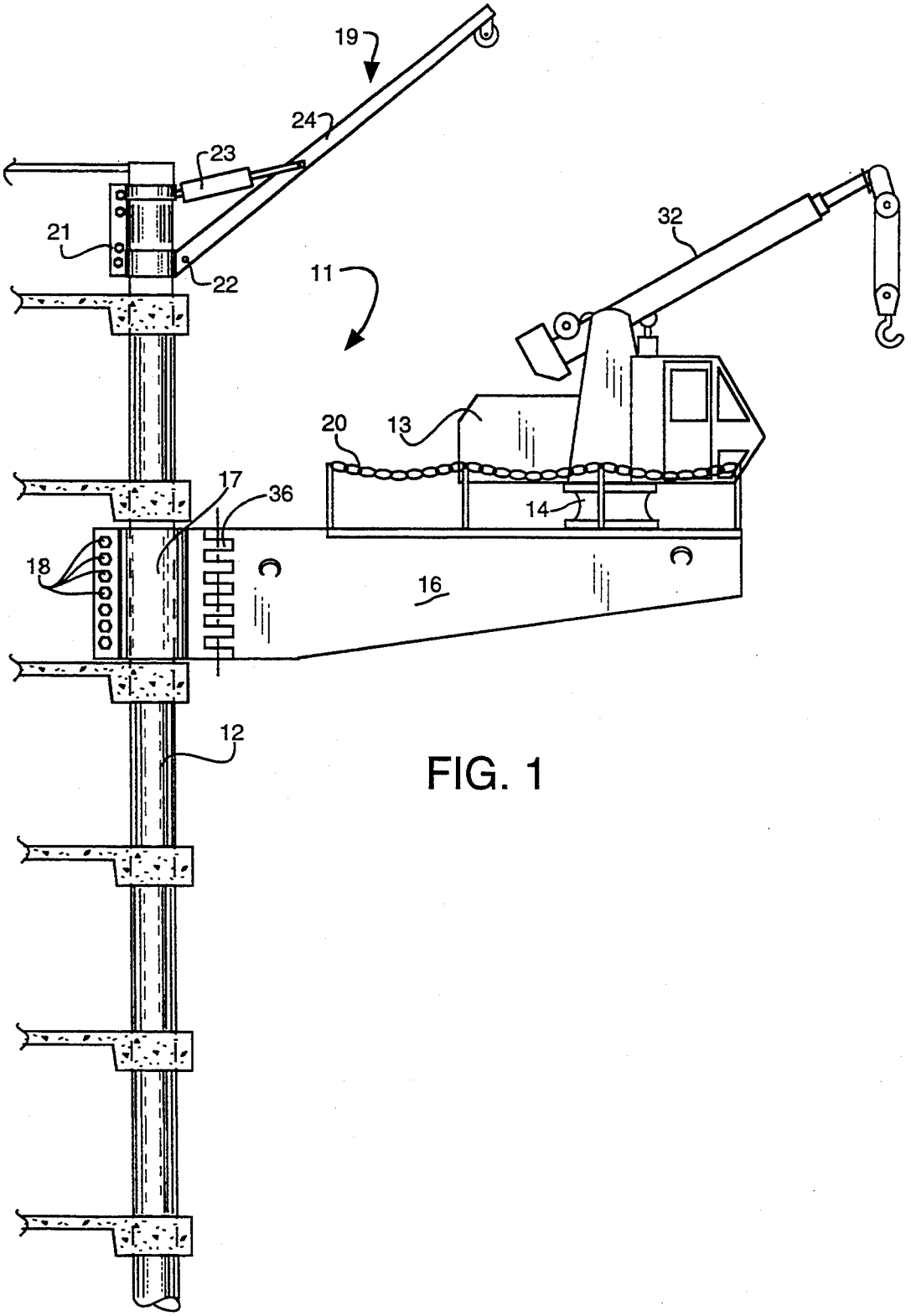
FIG. 1 is a schematic side view illustrating a preferred embodiment of the invention and its relationship to a building under construction.

The following relatively detailed description is provided to satisfy the patent statutes. However, it will be appreciated by those skilled in the art that various changes and modifications can be made without departing from the invention.

A preferred embodiment of the platform assembly of the invention is generally referred to by the reference 11. Such assembly 11 is as shown in the drawings, cantilevered from a vertical structural column 12 of a building under construction. It supports a crane represented at 13 via a standard crane base 14 which enables rotation of the crane. The crane 13 simply can be a pedestal mounted crane, such as a hydrocrane often used in construction projects for other purposes.

In keeping with the invention, the crane platform assembly is cantilererable from differing locations along the length of the structural column. The assembly includes both a platform 16 which provides the actual support for the crane and a latching collar 17 which can secure the same to the structural column both fixedly and non-movably relative to such column. Latching collar 17 is a three-piece friction collar having two clam shell sections which can be opened and closed so that the collar will alternately release and circumscribe a column as desired at a selected location. All the sections of such collar are lined with rubber so as to provide a friction securance. In the schematic showing in the drawing, a plurality of bolts 18 are illustrated holding the clam shell sections of the collar together surrounding the column in the selected location. In this connection, it is to be noted that the collar terminates at each end adjacent a floor/ceiling slab which provides structural bracing for the vertical column. The weight supported by the collar is high. (In one implementation the base itself weighed about 11,000 lbs. and the crane added to it about 20,000 lbs. This is in addition to any weight supported by the crane.) Moreover, such weight is cantilevered from the structural column. This grasping of the column by the collar adjacent the structural bracing provided by the slab enhances the ability of the column to support the crane, etc. A safety chain arrangement, schematically represented at 20, is included for the safety of personnel. Although details are not shown, the arrangement 20 is one which can be pivoted to be out of the way except when personnel need protection. Of course, any other safety arrangement can be provided as desired or to comply with local regulations.

It is desirable in many situations to include a pivot as part of the assembly. Such a pivot is represented at 36. To withstand the significant mechanical forces this pivot can have A SERIES OF tapered roller THRUST bearings. The decision to include such a pivot in a particular arrangement, will depend, of course, upon many factors, including the desired rotation versatility.

Figure 2:
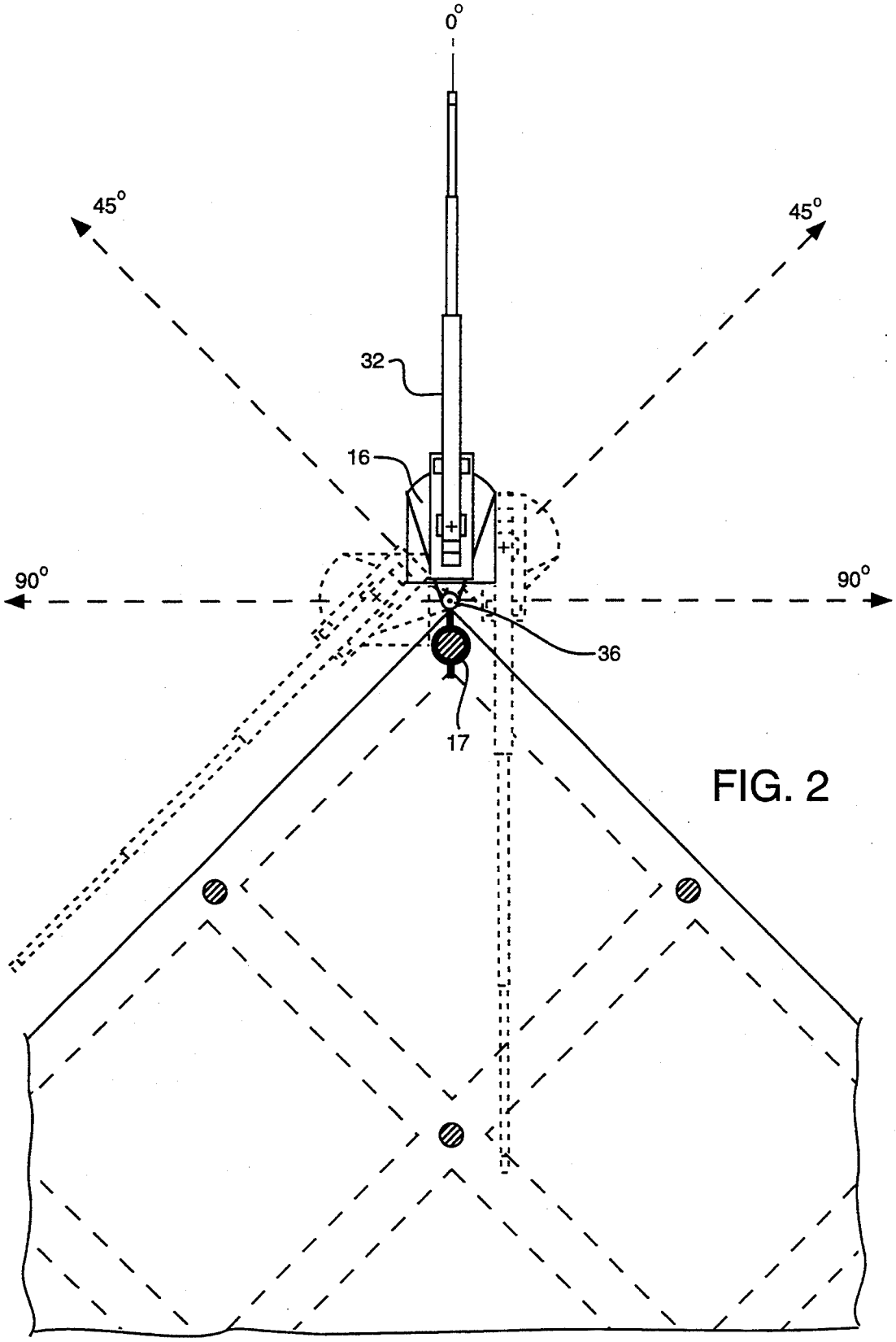
FIG. 2 is a schematic top elevation view illustrating differing positions of a crane and of the platform assembly of the invention when it includes a pivot.

FIG. 2 illustrates the operational capability of the invention. It is a plan view showing the assembly in solid attached to a corner structural column of a building. At such location the crane has access to any floor along two exterior walls, for example to facilitate installation of windows and exterior curtain walls between slabs. The crane also is usable to provide access interiorly of the surface area at the job site to be covered by the building. It will be appreciated that with a luffing jib (not shown in FIGS. 1–3 for simplicity) on the end of the crane boom access between already installed floor slabs also is possible. This interior access is important because it eliminates the need for landing platforms as commonly used.

It should be noted that in FIG. 2 there are two potential motions which are added together to provide the illustrated movement. One is a slewing of the platform itself about pivot 36 and the other is rotation of the crane on the platform. Although only a few different positions of the platform relative to the attaching means are illustrated, it will be appreciated that with the invention relatively unlimited positions can be provided. An operator can move between said positions simply by slewing the platform between the same. It will be recognized that when a pivot 36 is not included, the movement will be somewhat limited because it is only crane rotation on the platform which is available.

Figure 3:
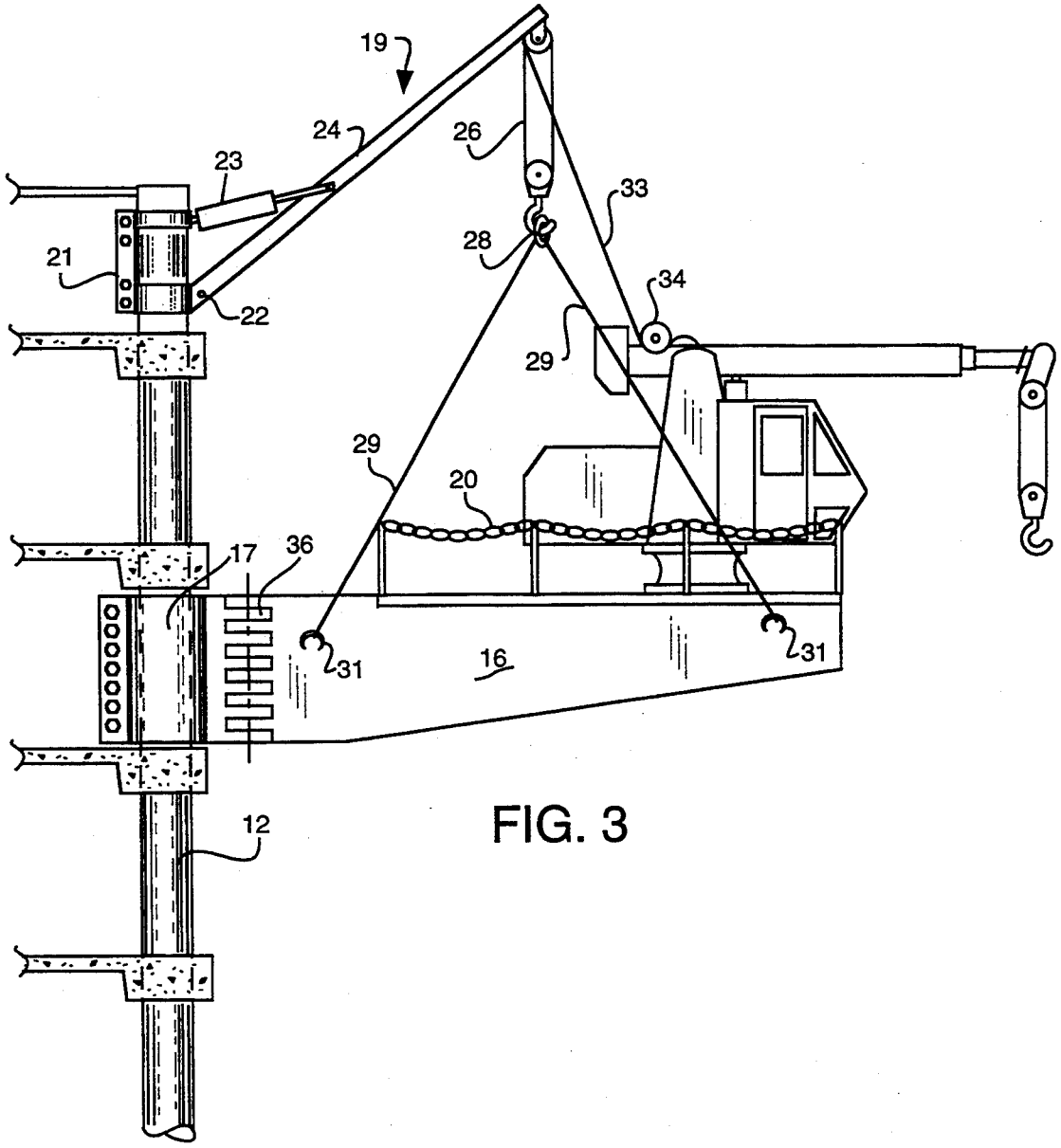
FIG. 3 is a schematic view similar to FIG. 1 illustrating the rigging associated with hoisting or lowering such preferred embodiment of the invention.

FIG. 3 illustrates the rigging for moving the platform assembly of the invention vertically between the differing locations. In this connection a lowering jib, represented at 19, acts to raise and lower the platform. Such jib is secured via a collar 21 to the upper end of the column 12 as is illustrated. That is, it is pivotally secured to the collar at 22, and a solenoid connection 23 is connected between the collar upper end and the jib boom 24 for changing the angular relationship of the latter as appropriate. A pulley set or block 26, akin to a block and tackle arrangement, is connected between the upper end of the boom and a suspension ring 28. The suspension ring, in turn, supports two cables, one of which is shown at 29, connected to the platform 16, on opposite sides thereof at suspension points, two on one side being shown and represented at 31. It will be seen that the location of the suspension ring 28 along the cables can be adjusted as necessary for balance. Moreover, when the crane base is suspended, the crane boom 32 can be extended or retracted for balance as desired.

The winch motor of the crane itself is used to power the block 26. In this connection, the line which operates the crane extends, as represented at 33, from the normal crane winch motor cable drum 34 to the upper sheave arrangement. In one specific design, the block 26 included seven lines, one of which is the line 33 extended to the cable drum 34.

Vertical movement of the crane between the differing locations on the structural column is a relatively simple procedure. The rigging for suspending the assembly needs to be installed and the friction collar released at the first position. Actuation and control of the jib, the winch and the position of the boom is effected by remote control, e.g., an operator on a floor slab of the building can move the assembly between the floor level of the "old" location and the "new" location. The friction collar is then reattached to the column at the new location. It is to be noted that there are only three different functions for raising and lowering the assembly, control of the winch, control of the jib solenoid, and control of the position of the boom.

Figure 4:
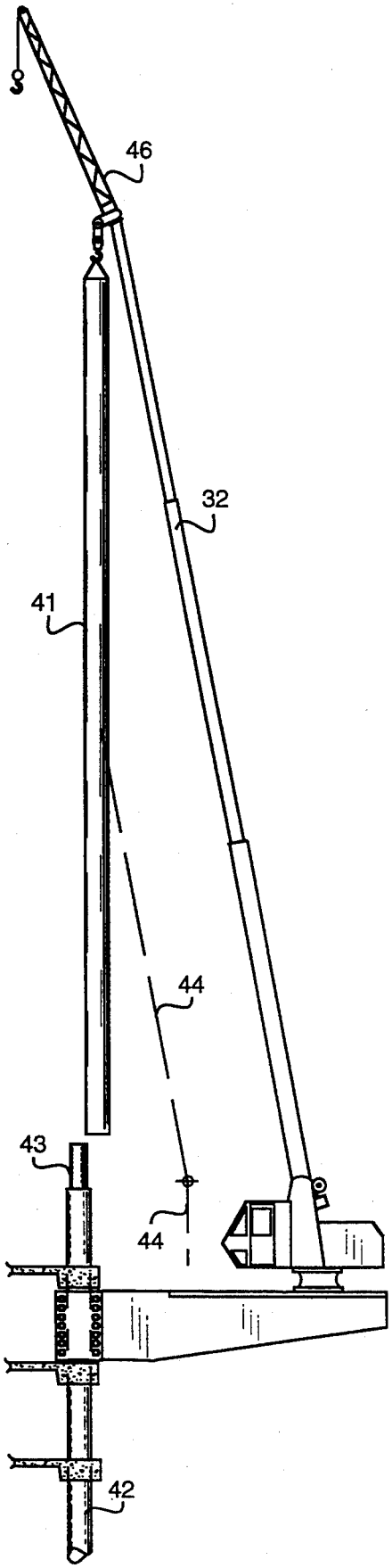
FIG. 4 is another schematic illustration showing how a preferred embodiment of the invention can be used to add a section on the very same structural column which supports the same.

The assembly of the invention permits a crane to be used to erect its own vertical support. In other words, when a platform assembly of the invention is at the highest location between levels provided by one section of column, it can be used to install the next higher section which then will provide the differing locations at which it is attached. In this connection, FIG. 4 illustrates a crane on the crane base of the invention installing a section 41 of a vertical structural column on a section 42 of the same already in place. While there are numerous ways in which two sections of a structural column can be rigidly attached together at their joint, one way is illustrated in FIG. 4 as part of the preferred embodiment shown. That is, the upper end of section 42 is relieved as indicated at 43 to accept a complementary cavity (not shown) at the lower end of the section 41 to be installed. The exposed joint between the sections can be welded, and concrete inserted within the section 41 to complete the portion of the vertical column it represents. Nelson studs and/or rebar is preferably provided to interact with the concrete to aid in forming a rigid joint. Once the section 41 is connected to the section 42, the structural frame platform can be moved to differing locations on the section 41 as structural bracing is provided.

It should be noted that the length of the section 41 is dependent upon the distance of the crane from the vertical column or, in other words, the length of the platform 16. If the platform is shorter than that shown, the beam section which can be raised is correspondingly shorter. To aid in illustrating the point, broken lines 44 are included to show the boom limitations relative to the center line of the column. It should be noted that the length of column section which can be suspended by the crane varies depending upon the suspension point. In the illustrated arrangement, the suspension point is at the top of the column section. As is known, though, vertical suspension can be obtained even with the suspension point being significantly lower along the length of the section. In one implementation of the invention, the platform was made sufficiently long to provide 20 ft. between the column and the center of rotation of the crane. This allowed approximately an 80 ft. section of column to be suspended from its top and added to a lower column section. The line 44 represents a crane-column spacing of only 10 ft. which will enable about a 40 ft. section of column to be suspended from its top and placed on top of a section already installed. It also should be noted that while as illustrated the platform assembly of FIG. 4 does not include a pivot, a pivot as described can be provided if desired.

As mentioned previously, the inclusion of a luffing jib on the end of the crane boom facilitates use of the crane to provide crane operations between levels for which the slabs have already been constructed. While for simplicity's sake such a luffing jib is not illustrated in connection with the earlier figures, such a luffing jib is shown in FIG. 4 at 46. It will be recognized that a luffing jib can be useful in many situations and the showing of the same only relative to FIG. 4, does not mean its use is limited to the remainder of the arrangement of FIG. 4. As mentioned previously, the use of such a luffing jib with the assembly of the invention enables one to obtain crane access between floor slabs and thereby eliminate the exterior landing platforms which are often provided.

As stated at the beginning of the detailed description, Applicant is not limited to the specific embodiments described. Various changes and modifications can be made. The specific embodiments are exemplary, rather than exhaustive. The claims, their equivalents and their equivalent language define the scope of protection.

What is claimed is:

1. In a platform assembly for use with a crane during the construction of a multi-story building, the combination comprising:

(a) a platform for supporting a crane having a winch; and (b) means for cantilevering said platform from differing locations along the length of a generally vertical structural column of said building during construction of said building.

2. The structure of claim 1 wherein said cantilevering means is adapted to fixedly, in a generally vertical direction, attach said platform directly to said structural column at said differing locations.

3. The structure of claim 1 wherein said cantilevering means comprises a collar configured to circumscribe said structural column at said differing locations.

4. The structure of claim 3 wherein said collar is configured to grasp said structural column adjacent structural bracing for said column.

5. The structure of claim 4 wherein said structural column is a corner column for said multi-story building.

6. The structure of claim 1 further including as part of said combination, a hoist for selectively moving said platform along the length of said structural column.

7. The structure of claim 1 further including as part of said combination, a crane mounted on said platform.

8. The structure of claim 7 wherein said crane includes a rotatable pedestal supporting the remainder of said crane rotatably on said platform.

9. The structure of claim 8 further including as part of said combination, a jib for selectively moving said platform generally vertically along said structural column and means connecting said jib to said crane for using the winch of said crane to power said hoist for moving said platform between said differing locations.

10. The structure of claim 1 wherein said cantilevering means includes attachment means providing a pivot between said cantilevering means and said platform which permits said platform to be rotated in a generally horizontal plane relative to said cantilevering means and hence relative to said structural column.

11. The structure of claim 10 wherein said pivot includes series of a tapered roller thrust bearings.

12. In a construction arrangement supporting a crane during the construction of a multi-story building, the combination comprising:

(a) a platform for supporting a crane rotatably thereon;

(b) means for cantilevering said platform from differing locations on a structural column of said building along the length of said column during construction of said building; and (c) a hoisting arrangement for selectively moving said platform vertically along said structural column.

13. The structure of claim 12 wherein said cantilevering means includes attachment means providing a pivot between said cantilevering means and said platform which permits said platform to be rotated in a generally horizontal plane relative to said cantilevering means and hence relative to said structural column.

* * * * *